US008307590B2

(12) United States Patent
Smith

(10) Patent No.: US 8,307,590 B2
(45) Date of Patent: Nov. 13, 2012

(54) ROOFTOP ACCESS SYSTEM

(75) Inventor: David L. Smith, Raytown, MO (US)

(73) Assignee: REACH Manufacturing, Inc., Raytown, MO (US)

( * ) Notice: Subject to any disclaimer, the term of this patent is extended or adjusted under 35 U.S.C. 154(b) by 420 days.

(21) Appl. No.: 11/270,697

(22) Filed: Nov. 9, 2005

(65) Prior Publication Data

US 2007/0107340 A1 May 17, 2007

(51) Int. Cl.
*E04B 7/00* (2006.01)

(52) U.S. Cl. ..... 52/198; 361/601; 52/62

(58) Field of Classification Search ..... 52/58, 60–62, 52/72, 98, 198, 200, 220.8; 361/601, 602, 361/622

See application file for complete search history.

(56) References Cited

U.S. PATENT DOCUMENTS

| | | | | |
|---|---|---|---|---|
| 2,375,513 | A * | 5/1945 | Bach | 248/59 |
| 2,610,816 | A * | 9/1952 | Vote | 248/27.1 |
| 4,599,828 | A | 7/1986 | Ishikura | |
| 4,747,505 | A * | 5/1988 | Hansen | 220/4.28 |
| 5,099,622 | A * | 3/1992 | Sutton | 52/200 |
| 5,349,790 | A * | 9/1994 | Beetles et al. | 52/19 |
| 5,467,565 | A | 11/1995 | Bowman | |
| 5,611,616 | A * | 3/1997 | Chandler | 362/154 |
| 5,971,444 | A * | 10/1999 | Hawkins | 285/206 |
| 6,792,726 | B1 | 9/2004 | Price | |
| 6,795,300 | B1 * | 9/2004 | Holley | 361/601 |
| 2004/0093813 | A1 * | 5/2004 | Sigrist et al. | 52/219 |
| 2004/0168398 | A1 | 9/2004 | Sakno | |

FOREIGN PATENT DOCUMENTS

| | | |
|---|---|---|
| JP | 4231453 | 8/1992 |

* cited by examiner

*Primary Examiner* — Branon Painter

(74) *Attorney, Agent, or Firm* — Intellectual Property Center, LLC; Arthur K. Shaffer

(57) ABSTRACT

A roof access system mounted on a roof having a roof support member, said device being adapted for use with an internal component and an external component. The device includes an enclosure and an access panel providing resealable access to a central aperture located through said enclosure, a channel extending from said aperture to the underlying roof support member and being adapted for receiving tubing extending from said internal component to said connection point. A second tubing section extends from the external component to said connection point, said internal component being in communication with said external component.

20 Claims, 4 Drawing Sheets

10

12
16
18
16a
14
16c
16b
24
24
2
30
8

ROOFTOP ACCESS SYSTEM

FIELD OF THE INVENTION

The present invention relates generally to rooftop structures and more particularly to a connection box mounted on a rooftop which penetrates the rooftop structure providing access to the building interior for the communication of exterior units.

BACKGROUND OF THE INVENTION

Commercial structures generally require integration between external and internal components during operation of the structure. Installation, service and modification of some external components may require coordination between different workers including HVAC, gas, fluid, electrical, communication, and controls workers with equipment located at various locations throughout the structure including on the roof exterior. These external components may be partially or wholly integrated into internal systems or components located within the building interior. However, access to the roof is often difficult to obtain, and once obtained may be difficult to coordinate different workers who may be needed to install the proper connections between the internal and external components. Therefore, it would be beneficial to provide improved roof access and a method for connecting internal and external components, allowing for multiple workers to work independently of each other while connecting the external component to the internal component.

A common method of providing a roof penetration is with a pitch box, which is a box installed around the lines penetrating the roof filled with tar. While this method may provide a weather resistant connection, this method does not readily allow for modification or service of the installed lines. In addition the use of tar allows for an unfavorable roof condition, as the tar is generally unpleasant when contact is initiated by a worker. It would be beneficial to provide a roof mounted device which provides a weather resistant joint while allowing for additional connections to be added or existing lines to be serviced while avoiding the use of tar to seal the connection.

In addition to service and installation considerations, building codes affect construction of and connection to various external and internal components. Commercial structures have various building codes to regulate the installation and modification of existing fixtures or components. However, generally speaking there has been no building code directed to the maintenance and upgrade of roof penetrations, thereby making installation, modification and service between internal and external components difficult, irregular and unpredictable. Because the pitch box does not provide easy modification or addition, commercial building codes may not specify how the roof penetration is to be maintained or serviced. It would therefore be beneficial to provide a roof access device which provides for the maintenance and service of roof penetrations, allow for a uniform environment which may be specified by various building codes.

Accordingly, a need exists for a roof access device that provides for installation, maintenance, upgrade, and service of roof penetrations between internal and external components, allowing for multiple workers to work independently. In addition, a need exists for connectors between internal components and internal components enclosed in a weather resistant enclosure while maintaining the necessary separation of services; that allows connections to be elevated from the roof surface; and that provides uniform installation, servicing and modifications required to provide for uniform building codes.

SUMMARY OF THE INVENTION

The present invention provides a rooftop access system mounted on a rooftop having an external component adapted for connection to an internal component located away from the rooftop, the system including an access panel and an enclosure having a mounting surface with a top and a bottom, the access panel being secured to the enclosure. A connection point is located on the external portion of the enclosure having an external socket associated with the mounting surface and an internal fitting associated with a central aperture preferably located on the bottom of the enclosure. The enclosure is secured to the rooftop with a rooftop mount, the connection point being adapted for placing the external component in communication with the internal component.

BRIEF DESCRIPTION OF THE DRAWINGS

The drawings constitute a part of this invention and include exemplary embodiments of the present invention and illustrate various objects and features thereof.

DETAILED DESCRIPTION

I. Introduction.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. Roof Access Hub Device.

Figure 1:
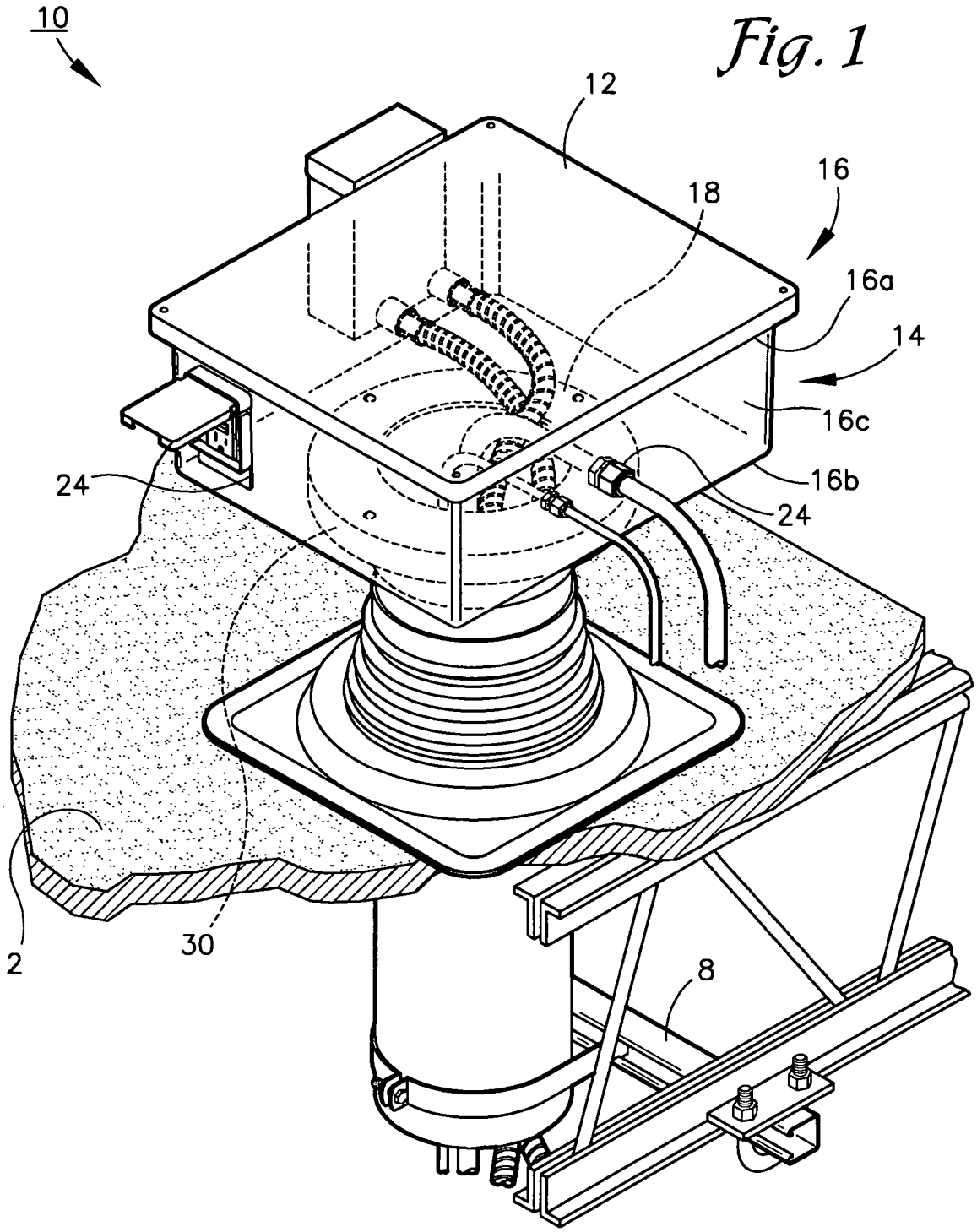
FIG. 1 is an upper perspective of a roof access hub device in association with a roof structure of a building.
Figure 2:
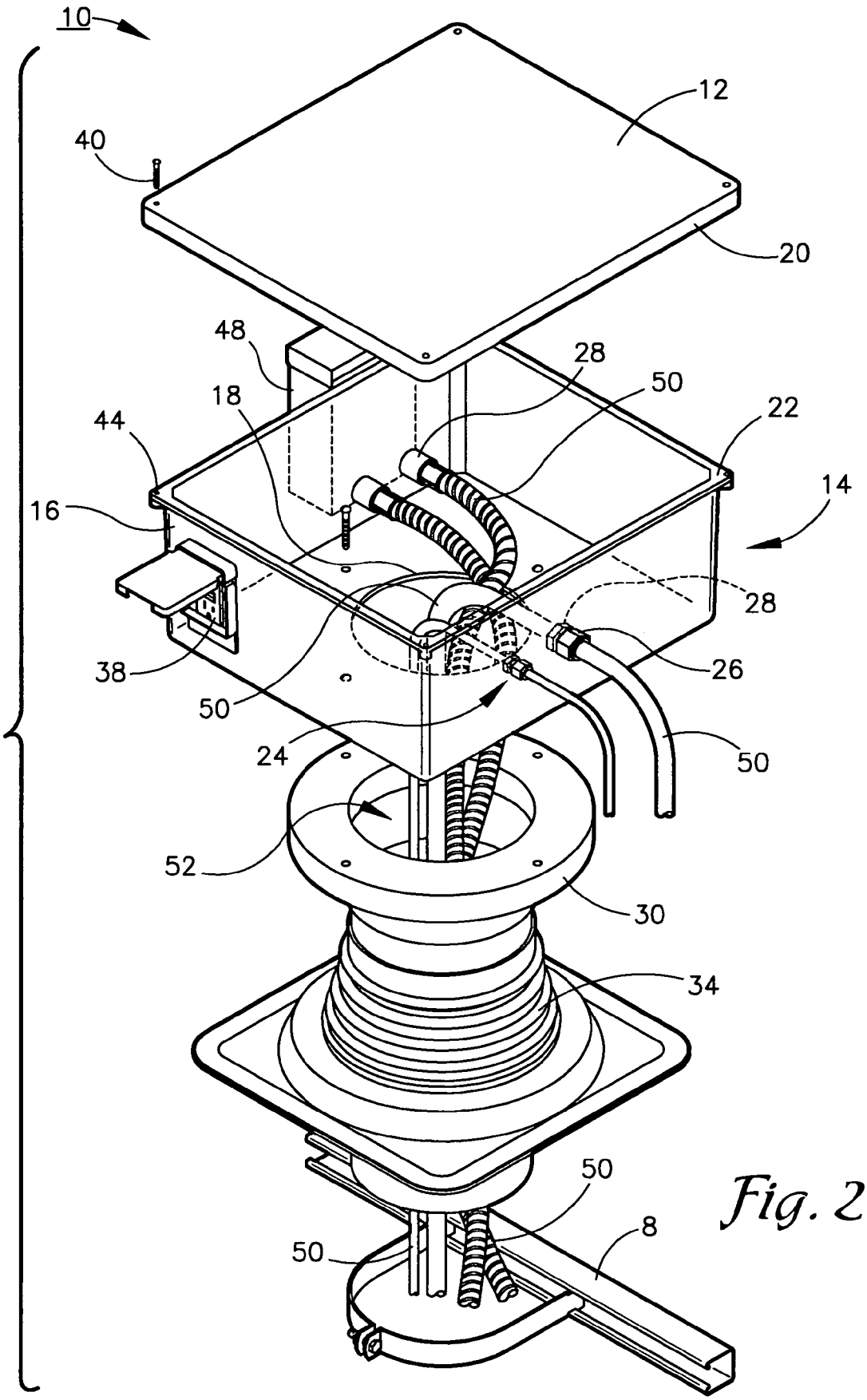
FIG. 2 is an exploded upper perspective view of the roof hub device.

Referring to FIGS. 1 and 2, an embodiment of the present invention in association with a roof member of a building structure is generally indicated by reference numeral 10, while the roof is generally indicated by the reference numeral 2. The rooftop access hub device 10 generally includes an enclosure 14 with a mounting surface 16 having a top 16*a* and a bottom 16*b* joined by a side 16*c*, the top and bottom 16*a*, 16*b* preferably having a rectangular configuration. The mounting surface 16 is illustrated with at least one and preferably multiple connection points 24 located along the side 16*c* of the enclosure 14.

The connection point 24 is configured with an internal and an external portion, the internal portion generally including an internal fitting 28 located internally to the enclosure, while the external portion generally includes an external socket 26 located along the external surface of the enclosure 14. The internal portion is covered by the enclosure 14 while the external portion is generally secured to the enclosure 14. The connection point 24 may include but is not limited to at least one of the electrical connection, refrigerant connection and plumbing connection, among others.

An access panel 12 is illustrated in FIG. 1 as a substantially planar, horizontally positioned panel, adapted for providing resealable access to a central aperture 18 located through said enclosure 14. Although the central aperture 18 is illustrated as being generally circular, the aperture may include a variety of shapes and dimensions adapted to provide access to a building or other structure connected to the roof 2.

FIG. 2 illustrates the access panel 12 removed from the enclosure. The access panel 12 is shown with a depending lip 20 circumscribing the panel 12. The depending lip 20 is adapted for being releasably joined to the enclosure 14 along a ledge 22 extending along the top perimeter of the enclosure 14. The access panel 12 is illustrated as being joined to the enclosure 14 with at least one mechanical fastener 40, e.g. a screw 42 threadably received by a threaded receiver 44 located within the ledge 22. In addition, the bottom mounting surface 16*c* is secured to the rooftop mount 30, which is adapted for securely supporting the enclosure 14, protecting the underlying connected structure from damage, while providing access to the internal component 6 and the external component 4. Generally, the external component 4 and internal component 6 are each connected using a section of tubing 50, which may include but is not limited to electrical conduit, plumbing pipe, refrigerant lines, gas lines, communications cables, wire or other connection materials, to provide electrical or fluid communication between the external component 4 and the internal component 6.

Tubing 50 is illustrated extending from the internal fitting 28 through the central aperture 18, through the rooftop mount 30 and into the underlying structure for connection to the internal component. A second section of tubing 50 is also illustrated extending from the external socket 26 for connection to the external component 4. The first and second tubing sections 50 generally allow the internal component 6 to communicate with the external component 4.

As is seen in FIG. 2, a channel or raceway 52 extends between a roof support member 8 and the enclosure 14 terminating at the central aperture 18. The channel 52 is adapted for receiving the tubing 50 extending between the internal fitting 28 and the internal component 6. A roof boot 34 is also illustrated in FIG. 2 extending towards the enclosure 14, protecting the rooftop mount 30. The roof boot 34 provides a protective membrane around the channel 52 and the supporting rooftop mount structure 30, while allowing the alignment of the channel 52 with the roof supporting member 8 located within the underlying structure. The roof support member 8 is comprised of a combination cross-member and one or more arcuate straps. The cross-member is secured directly to an underlying rooftop structure using known fasteners such as clamps. In the embodiment of FIGS. 1 and 2, the pair of arcuate straps secures the channel 52 to the cross-member and are secured together at one end opposite the cross-member, each arcuate straps including a shaped end for slidable receipt by a complementary portion of the cross-member. The arcuate straps are shaped for extending around a cylindrical support structure 132 (shown in FIG. 4). In the embodiment of FIGS. 1 and 2, a depending and appending lip extends from top and bottom sidewalls of the cross-member for securing the shaped end of the arcuate straps. In addition, the enclosure in FIG. 2 includes an optional outlet 38 and electrical disconnect 48 mounted on the mounting surface 16. The electrical disconnect 48 includes an internal portion which may include plural internal fittings 28 connected to the electrical disconnect 48. As is commonly known, the external portion may have a variety of external socket 26 configurations for connecting the external component 4, which in the case of the electrical disconnect 48 may include but is not limited to a fusible connection, a plug-style connection or a circuit-breaker disconnect style connection.

Figure 3:
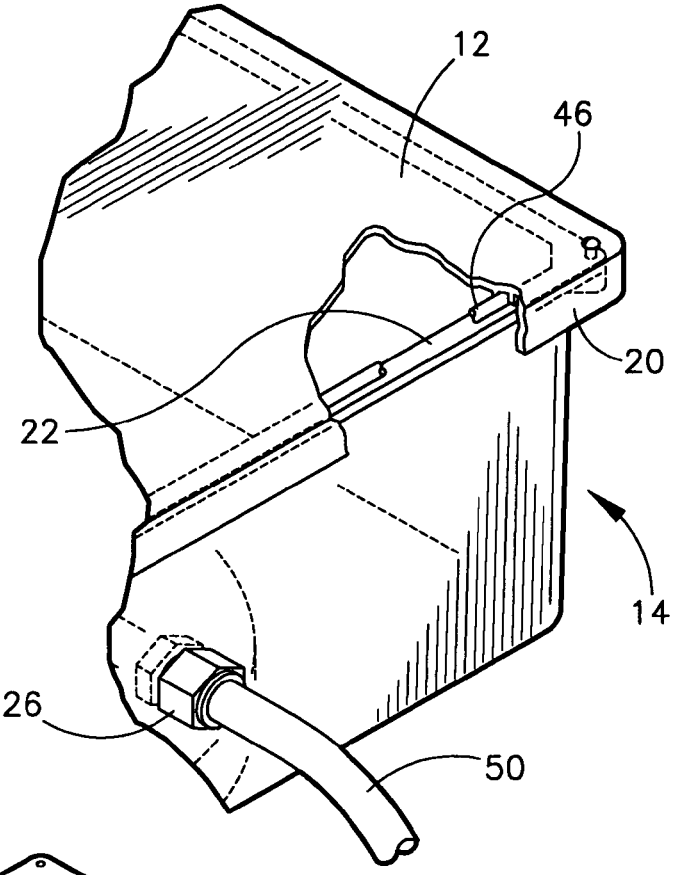
FIG. 3 is a fragmentary view of the upper portion of the roof hub device.

FIG. 3 illustrates the enclosure 14 in receipt of the access panel 12, the depending lip 20 extending over the ledge 22. The enclosure 14 in combination with the access panel 12 may form a protective covering for the internal portions including the tubing 50, channel 52 and the roof support member 8 of the underlying structure. In addition, either the enclosure 14 or the access panel 12 may include an optional liner 46 adapted for providing a weather resistant barrier around the enclosure 14/access panel 12 connection. The external socket 26 is also visible in FIG. 3 with the second section of tubing 50 extending from the external socket 26 towards an external component 4.

In operation and referring back to FIGS. 1-2, the roof hub device 10 is mounted to a roof top mount 30 preferably secured to a roof support member 8 within the underlying structure. The enclosure 14 of the roof hub device 10 includes the central aperture 18 from which the channel 52 extends towards the underlying structure. The internal component 6 is then placed in communication with the external component 4 at the roof hub device 10. Alternatively, multiple internal components may be communicated to multiple external components in practice of the present invention.

As an illustration, the internal component 6 which may include a refrigerator, gas stove or oven, HVAC equipment, control system or other internal devices may be connected to a distal end of tubing 50 which may include a section of conduit. In some occasions this may be performed by a single trade worker such as an electrician, plumber or other skilled worker. The proximate end of the tubing 50 may then be extended through the channel 52 and into the enclosure 14 located on the roof 2. Removal of the access panel 12 allows the proximate end of the tubing 50 to be secured to the internal fitting 28. The external component 4 which may include an exhaust fan, condenser/evaporator unit, roof mounted temperature sensor or other external device, may then be connected to the distal end of a second section of tubing 50. The proximate end of the second tubing section 50 may then be connected to the external socket 26 located along the side mounting surface 16*b*. This may be installed by the same worker who connected the interior component 6 or by any other worker, at the same or a different time without requiring coordination between the different workers. In this way, the internal component 6 is placed in communication with the external component 4.

Figure 4:
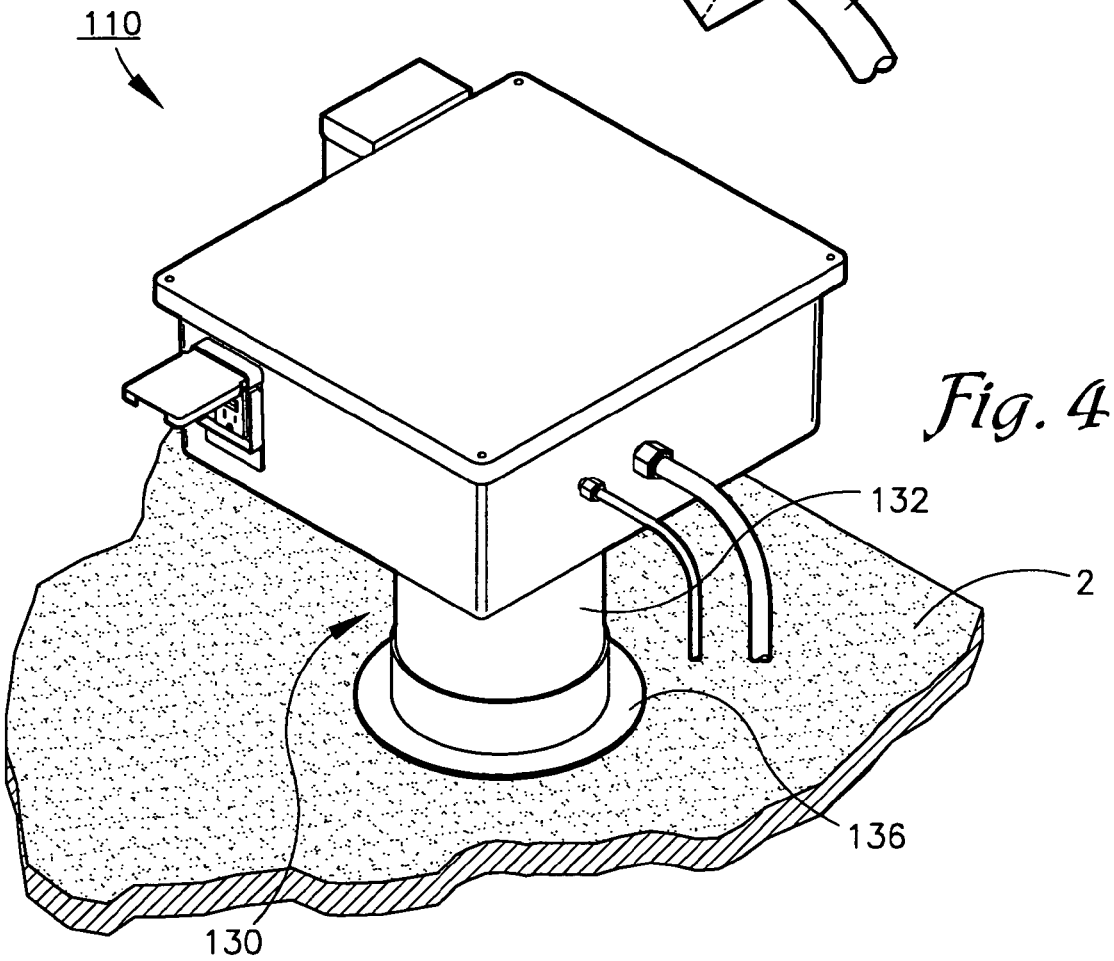
FIG. 4 is an upper perspective view of an alternative configuration of the roof hub device.

FIG. 4 illustrates an alternative configuration of the roof access hub device 110 with a roof top mount 130 including a roof gasket 136 extending from a cylindrical support structure 132 along the roof 2. The roof gasket 136 is adapted for being secured to the roof 2 typically with an adhesive sealing compound, although other connections may be utilized by the roof gasket 136 such as a mechanical connection.

Figure 5:
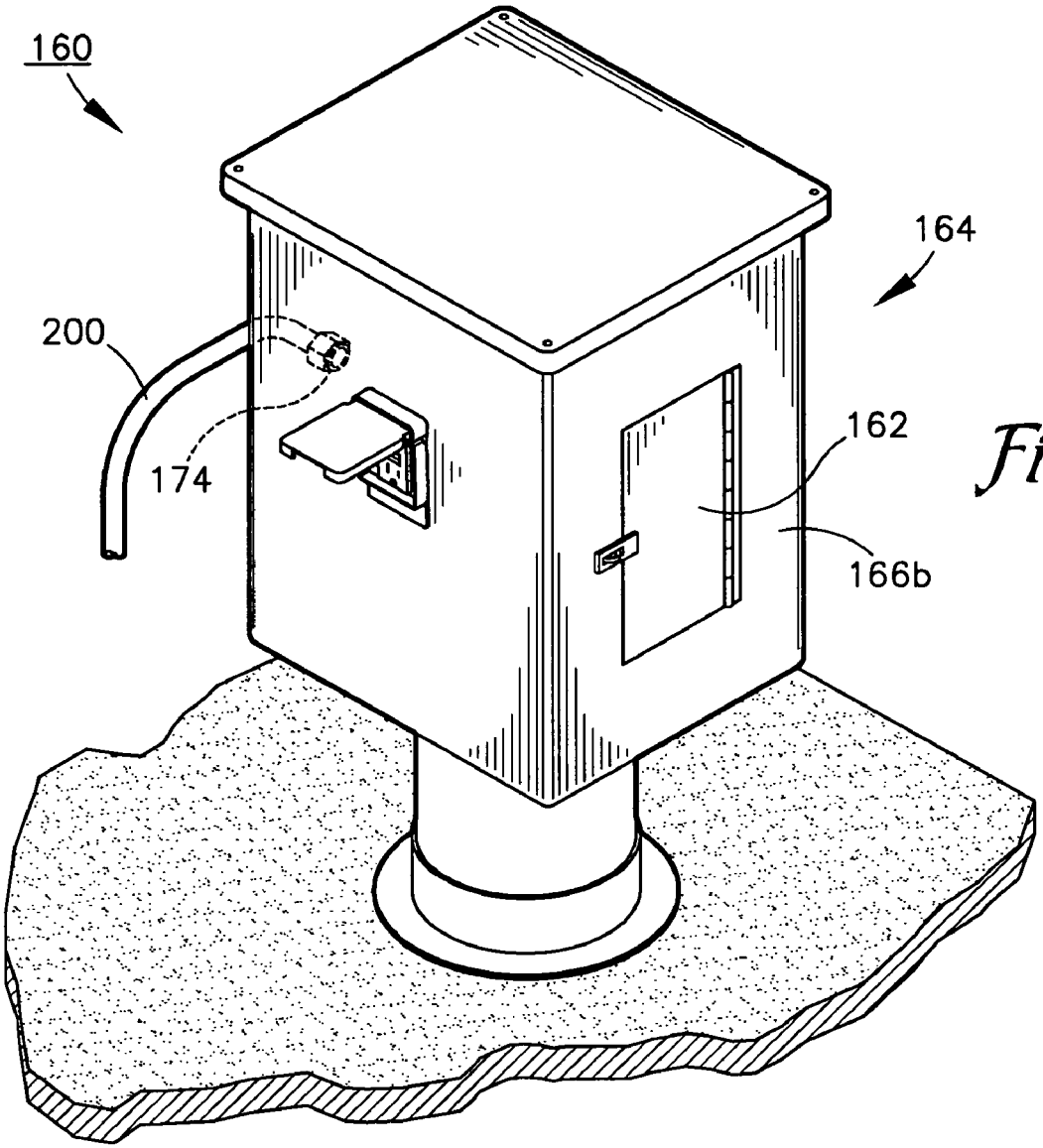
FIG. 5 is an upper perspective view of an additional, alternative configuration of the roof hub device.

FIG. 5 illustrates another alternative configuration of the roof access hub device 160 including a substantially planar, vertically orientated enclosure 164 with a side access panel 162 extending along a side mounting surface 166*b*, the side access panel 162 providing access for connectably securing a tubing section connected between the internal component 6 and an internal portion of a connection point 174, a second tubing section 200 being connected to the external component 4 and to the external portion of the connection point 174, the internal component 6 being placed in communication with the external component 4.

It will be appreciated that various other configurations and embodiments may fall within the scope of the present invention. While certain forms of the present invention have been illustrated and described herein, it is not to be limited to the specific forms or arrangement of parts described and shown.

Having thus described the invention, what is claimed as new and desired to be secured by Letters Patent is as follows:

1. A rooftop access system mounted on a low slope rooftop for connecting an external component on said rooftop to an internal component located within an underlying roof structure, said external component and said internal component comprising a subsystem wherein one of said internal and said external component comprises an ancillary subsystem component and the other a primary subsystem component, said rooftop access system comprising:

an enclosure formed by a top wall joined to a bottom wall by at least one side wall, a central aperture formed through said bottom wall, an access panel releasably secured to said enclosure and providing access to said central aperture, a rooftop mount extending through said rooftop and secured directly to said underlying roof structure below said rooftop by a cross-member and at least one arcuate strap, said rooftop mount in communication with said cross-member and having a ring connector extended radially outwardly from a channel associated with said rooftop mount and adapted for supporting said enclosure in direct connection with said cross-member, said bottom wall being releasably fastened to said ring connector, said arcuate strap received by said cross-member for alignment of said central aperture with said ring connector thereby aligning said enclosure with said cross-member, a cylindrical roof boot having a variable radial step profile with a projection of comparable diameter to a diameter of said channel extending downwardly from said rooftop mount towards said cross-member, said channel being received through said projection whereby said roof boot extends along said channel between said rooftop and said enclosure for alignment of said channel from said cross-member through said roof boot to said enclosure, and a connection point supported on a wall of said enclosure and extending through said enclosure wall, said connection point including a fitting to removably interconnect a pair of pipes to thereby enable fluid communication between said primary subsystem component and said ancillary subsystem component by way of said connection point.

2. The system according to claim 1 wherein said rooftop mount elevates said enclosure upwardly from the roof.

3. The system according to claim 1 further comprising said access panel being substantially planar having a generally horizontal orientation, said access panel providing superior access to said central aperture.

4. The system according to claim 1 further comprising said access panel being substantially planar having a generally vertical orientation, said access panel providing side access to said central aperture.

5. The system according to claim 1 further comprising: a depending lip circumscribing said access panel, and said side wall including a ledge extending along a top edge thereof for resealably receiving said depending lip.

6. The system according to claim 1 further comprising a weather resistant seal located between said access panel and said side wall of said enclosure.

7. The system according to claim 6 wherein said weather resistant connection further comprises an inner liner located between said access panel and said side wall of said enclosure.

8. The system according to claim 1 wherein said fitting further comprises:

an external socket supported on an exterior side of a wall of said enclosure, and an internal fitting supported on an interior side of said wall of said enclosure, said internal fitting communicating with said external socket to thereby enable communication of said external component with said internal component.

9. The system according to claim 8 wherein said pair of pipes further comprises:

a first tubing section adapted for connection to the internal component and having a first tubing distal end separated from a first tubing proximate end, a second tubing section adapted for connection to the external component and having a second tubing distal end separated from a second tubing proximate end, said first tubing proximate end being removably connected to said internal fitting, said second tubing proximate end being removably connected to said external socket, and said first tubing distal end being connected with said internal component and said second tubing distal end being connected with said external component to thereby enable said fluid communication between said external component and said internal component.

10. The system according to claim 1 wherein said roof boot further includes a gasket secured to the roof.

11. The system according to claim 1 and further including an electrical connection point supported on a wall of said enclosure and including an electrical connector to enable removable electrical connection between an internal electrical component and an external electrical component.

12. The system according to claim 1 wherein said internal component is a trade related subsystem component wherein said trade is selected from the group consisting of: electrical, plumbing, communications, HVAC, and controls.

13. The system according to claim 1 wherein said external component is a trade related roof mounted subsystem component wherein said trade is selected from the group consisting of: electrical, plumbing, communications, HVAC, and controls.

14. The system according to claim 1 wherein said external component is in communication with said internal component through a connection medium selected from the group consisting of: electrical conduit, plumbing pipe, refrigerant lines, gas conduit, and communication cables.

15. A rooftop access system mounted on a low slope rooftop for connecting a plurality of external components on said rooftop respectively to a plurality of internal components located at various locations within an underlying roof structure, said internal components and said external components comprising a plurality of subsystems wherein one of said internal and said external components comprises an ancillary subsystem component and the other a primary subsystem component within the same subsystem, said rooftop access system comprising:

an enclosure formed by a top wall joined to a bottom wall by at least one side wall, a central aperture extending through said bottom wall, an access panel releasably secured to said enclosure and providing access to said central aperture, a rooftop mount extending through said rooftop and secured directly to said underlying roof structure below said rooftop by a cross-member and at least one arcuate strap, said rooftop mount in communication with said cross-member and having a ring connector extended radially outwardly from a channel associated with said rooftop mount and adapted for supporting said enclosure in direct connection with said cross-member, said bottom wall being releasably fastened to said ring connector, said arcuate strap received by said cross-member for alignment of said central aperture with said ring connector thereby aligning said enclosure with said cross-member, a cylindrical roof boot having a variable radial step profile with a projection of comparable diameter to a diameter of said channel extending downwardly from said rooftop mount towards said cross-member, said channel being received through said projection whereby said roof boot extends along said channel between said rooftop and said enclosure for alignment of said channel from said cross-member through said roof boot to said enclosure, and a plurality of connection points supported on a wall of said enclosure and extending through said enclosure wall, each connection point including a respective fitting to removably interconnect a respective pair of pipes to thereby enable fluid communication between an associated subsystem ancillary component and a subsystem primary component within the same subsystem.

16. The system according to claim 15 and further including an electrical connection point supported on a wall of said enclosure and including an electrical connector to enable removable electrical connection between an internal electrical component and an external electrical component.

17. The system according to claim 15 wherein each of said plurality of external components is a trade related roof mounted subsystem component wherein said trade is selected from the group consisting of: electrical, plumbing, communications, HVAC, and controls.

18. The system according to claim 15 wherein each of said plurality of internal components is a trade related subsystem component wherein said trade is selected from the group consisting of: electrical, plumbing, communications, HVAC, and controls.

19. A rooftop access system mounted on a low slope rooftop for connecting an external component on said rooftop to an internal component located within an underlying roof structure, said external component and said internal component comprising a ancillary subsystem component and the other a primary subsystem component, said rooftop access system comprising:

an enclosure formed by a top wall joined to a bottom wall by at least one side wall, a central aperture extending through said bottom wall, an access panel releasably secured to said enclosure and providing weather resistant access to said central aperture, a rooftop mount extending through said rooftop and secured directly to said underlying roof structure below said rooftop by a cross-member and at least one arcuate strap, said rooftop mount in communication with said cross-member and having a ring connector extended radially outwardly from a channel associated with said rooftop mount and adapted for supporting said enclosure in direct connection with said cross-member, said bottom wall being releasably fastened to said ring connector, said arcuate strap received by said cross-member for alignment of said central aperture with said ring connector thereby aligning said enclosure with said cross-member, a cylindrical roof boot having a variable radial step profile with a projection of comparable diameter to a diameter of said channel extending downwardly from said rooftop mount towards said cross-member, said channel being received through said projection whereby said roof boot extends along said channel between said rooftop and said enclosure for alignment of said channel from said cross-member through said roof boot to said enclosure, a first tubing section and a second tubing section, a connection point supported on a wall of said enclosure and extending through said enclosure wall, said connection point including an external socket located on an exterior side of said enclosure wall and an internal fitting located on an internal side of said enclosure wall and internally located within said enclosure, said external socket being in fluid communication with said internal fitting, said external socket being removably connected by said second tubing section to said external component, and said internal fitting being removably connected to one of said primary subsystem component and said ancillary subsystem components by said first tubing section and said first tubing section extending through said channel, whereby the other of said subsystem components is placed in fluid communication with one of said primary subsystem component and said ancillary subsystem components by way of said connection point.

20. The system according to claim 19 and further including an electrical connection point supported on a wall of said enclosure and including an electrical connector to enable removable electrical connection between an internal electrical component and an external electrical component.

* * * * *